US011652308B2

(12) United States Patent
Asano

(10) Patent No.: US 11,652,308 B2
(45) Date of Patent: May 16, 2023

(54) CONNECTOR

(71) Applicant: HOSIDEN CORPORATION, Osaka (JP)

(72) Inventor: Takao Asano, Gunma (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 17/373,996

(22) Filed: Jul. 13, 2021

(65) Prior Publication Data

US 2022/0021141 A1 Jan. 20, 2022

(30) Foreign Application Priority Data

Jul. 15, 2020 (JP) ..... JP2020-121370

(51) Int. Cl.
*H01R 12/00* (2006.01)
*H01R 12/70* (2011.01)
(Continued)

(52) U.S. Cl.
CPC ..... *H01R 12/707* (2013.01); *H01R 12/57* (2013.01); *H01R 13/26* (2013.01);
(Continued)

(58) Field of Classification Search
CPC ..... H01R 12/707; H01R 12/57; H01R 13/26; H01R 13/6474; H01R 13/50; H01R 13/6582; H01R 13/6594; H01R 13/6461; H01R 2107/00; H01R 24/60; H01R 12/724; H01R 13/02; H01R 12/51; H01R 13/6473; H01R 13/652; H01R 13/533; H01R 13/22; H01R 13/6581
See application file for complete search history.

(56) References Cited

U.S. PATENT DOCUMENTS 5,906,518 A * 5/1999 Sun ..... H01R 12/732 439/295
6,227,907 B1 5/2001 Wu et al.
(Continued)

FOREIGN PATENT DOCUMENTS

EP 0874421 A1 10/1998
JP 2009009728 A 1/2009

OTHER PUBLICATIONS

European Search Report from European Application No. 21184510.2 dated Mar. 12, 2021.

*Primary Examiner* — Abdullah A Riyami
*Assistant Examiner* — Nelson R. Burgos-Guntin
(74) *Attorney, Agent, or Firm* — Dilworth & Barrese, LLP

(57) ABSTRACT

A connector mounted on a substrate includes: a plurality of contacts; and a housing, wherein the plurality of contacts include a plurality of first contacts arranged next to one another in a first row and a plurality of second contacts arranged next to one another in a second row parallel to and apart from the first row, the connector further including: for the first row, at least one electrically conductive first bar-shaped member which is present further outward than a first outermost one of the first contacts, which is fixed to the substrate, and which is supported by the housing; and for the second row, at least one electrically conductive second bar-shaped member which is present further outward than a first outermost one of the second contacts, which is fixed to the substrate, and which is supported by the housing.

16 Claims, 6 Drawing Sheets

(51) Int. Cl.

| | |
|---|---|
| ***H01R 12/57*** | (2011.01) |
| ***H01R 13/26*** | (2006.01) |
| ***H01R 13/6474*** | (2011.01) |
| *H01R 13/50* | (2006.01) |
| *H01R 13/6582* | (2011.01) |

(52) U.S. Cl.
CPC ..... *H01R 13/6474* (2013.01); *H01R 13/50* (2013.01); *H01R 13/6582* (2013.01)

(56) References Cited

U.S. PATENT DOCUMENTS

| | | | | |
|---|---|---|---|---|
| 2009/0029567 | A1* | 1/2009 | Yi | H01R 12/57 439/66 |
| 2013/0203290 | A1* | 8/2013 | Zhang | H01R 12/716 439/607.36 |
| 2016/0013592 | A1* | 1/2016 | Kao | H01R 13/6471 439/607.55 |
| 2019/0103709 | A1* | 4/2019 | Xu | H01R 13/6585 |
| 2022/0021141 | A1* | 1/2022 | Asano | H01R 12/724 |

* cited by examiner

CONNECTOR

CROSS REFERENCE TO RELATED APPLICATION

This application is based on and claims priority under 35 U.S.C. Section 119 to Japanese Patent Application No. 2020-121370 filed on Jul. 15, 2020, the entire content of which are incorporated herein by reference.

TECHNICAL FIELD

This disclosure relates to a connector including a plurality of contacts arranged next to one another in two rows.

BACKGROUND ART

There has been known an HDMI (registered trademark) Type A connector for high-speed differential signal transmission (see, for example, JP2009-9728A). A Type A connector includes nineteen contacts constituted by (i) four sets of contacts each of which sets is made up of three contacts, namely one ground terminal and two signal terminals as a differential pair, and (ii) one set of seven contacts including a control CEC terminal.

JP2009-9728A discloses a connector including (i) a plurality of contacts ("signal terminals" and "ground terminals" in the document) arranged next to one another in two rows and (ii) a housing ("molded portion" in the document) supporting the plurality of contacts. The contacts have respective end portions fixed to a substrate. The contacts also have respective wide portions supported by the housing. The respective wide portions of the signal terminals and those of the ground terminals are adjacent to one another and exposed to the outside on a back surface of the housing which back surface is opposite to a plug insertion opening. This allows static electricity to be discharged from the respective wide portions of the signal terminals to those of the ground terminals through the air.

SUMMARY

The connector disclosed in JP2009-9728A includes a housing having a cutout to expose the respective wide portions of the signal terminals and those of the ground terminals. This leads to the contacts being each held with an accordingly reduced force. The connector is thus not stably fixed to the substrate. In particular, the outermost contacts are easily detachable from the substrate, with the result of a poor signal transmission characteristic.

The above circumstances have led to a demand for a connector mounted on a substrate which connector is not easily detachable from the substrate and has a good signal transmission characteristic.

In order to satisfy the above demand, a connector as an aspect is a connector mounted on a substrate, the connector including: a plurality of contacts each including at a first end a contact portion to which a terminal of a mating connector is electrically connectable and at a second end a fixing portion fixed to the substrate; and a housing supporting the plurality of contacts, wherein the plurality of contacts include a plurality of first contacts arranged next to one another in a first row and a plurality of second contacts arranged next to one another in a second row parallel to and apart from the first row, the connector further includes: for the first row, at least one electrically conductive first bar-shaped member which is present further outward than a first outermost one of the first contacts, which is fixed to the substrate, which is supported by the housing, and to which the mating connector is not electrically connectable; and for the second row, at least one electrically conductive second bar-shaped member which is present further outward than a first outermost one of the second contacts, which is fixed to the substrate, which is supported by the housing, and to which the mating connector is not electrically connectable.

A connector with contacts and its substrate may receive a repeated external or internal stress due to, for example, vibration or a temperature increase. This may cause the connector to become detached from the substrate. If the connector becomes detached from the substrate as such, an outermost one of the contacts tends to first start becoming detached from the substrate.

In view of that, the above aspect includes at least one first bar-shaped member and at least one second bar-shaped member in addition to a plurality of contacts arranged in two rows. The first bar-shaped member is present further outward than an outermost one of the contacts in a first one of the two rows. The first bar-shaped member is also fixed to the substrate and supported by the housing. The second bar-shaped member is present further outward than an outermost one of the contacts in a second one of the two rows. The second bar-shaped member is also fixed to the substrate and supported by the housing. The first and second bar-shaped members are not electrically connectable to a mating connector and serve to protect the contacts. The first and second bar-shaped members are, in other words, present outward of signal transmission contacts. Even if the connector becomes detached from the substrate, the first and second bar-shaped members first become detached, preventing the contacts from becoming detached and from having an impaired signal transmission function. Further, the first and second bar-shaped members are present respectively for the two rows, allowing the contacts to be fixed to the substrate firmly.

An outermost contact is next to an adjacent one only on one side, and would thus tend to have a high impedance. The above arrangement, however, includes electrically conductive first and second bar-shaped members each present further outward than such an outermost contact. Using the first and second bar-shaped members as ground terminals allows the connector as a whole to have a well-balanced impedance. The above arrangement thereby provides a connector mounted on a substrate which connector is not easily detachable from the substrate and has a good signal transmission characteristic.

The connector may be arranged as a preferable aspect such that the at least one first bar-shaped member includes two first bar-shaped members opposite to each other in such a manner as to enclose the first contacts, and the at least one second bar-shaped member includes two second bar-shaped members opposite to each other in such a manner as to enclose the second contacts.

The above aspect includes, for the first row, two first bar-shaped members that are opposite to each other in such a manner as to enclose a plurality of contacts and, for the second row, two second bar-shaped members that are opposite to each other in such a manner as to enclose a plurality of contacts. This allows the contacts to be fixed to the substrate more firmly, and thereby reliably prevents the contacts from becoming detached.

The connector may be arranged as a preferable aspect such that the first contacts are present in an even number and next to one another at a predetermined distance, the second contacts are present in an odd number and next to one another at the predetermined distance, the at least one first bar-shaped member is next to the first outermost one of the first contacts at the predetermined distance, and the at least one second bar-shaped member is next to the first outermost one of the second contacts at the predetermined distance.

The above aspect includes even-numbered contacts next to one another at an equal distance in the first row, odd-numbered contacts next to one another at the equal distance in the second row, the at least one first bar-shaped member next to the first row at the same distance, and the at least one second bar-shaped member next to the second row at the same distance. This allows the contacts and the bar-shaped members both fixed to the substrate to be next to one another in a well-balanced pattern. This allows the contacts to be fixed to the substrate more firmly, and thereby reliably prevents the contacts from becoming detached.

The connector may be arranged as a preferable aspect such that the at least one first bar-shaped member and the at least one second bar-shaped member are each identical in shape to each of the plurality of contacts except for lack of the contact portion.

Preparing the first and second bar-shaped members each by cutting the contact portion off a contact as for the above aspect allows mass production of identically shaped contacts and thereby reduces the production cost.

The connector may be arranged as a preferable aspect such that the housing includes a base portion and a protruding portion protruding from the base portion and supporting the plurality of contacts, and the base portion has (i) a plurality of through holes in which the plurality of contacts are partially present and (ii) a plurality of hole portions which are blocked on a side of the protruding portion and in which the at least one first bar-shaped member and the at least one second bar-shaped member are partially present.

The above aspect is arranged such that the hole portions, which receive the at least one first bar-shaped member and the at least one second bar-shaped member, are blocked on the side of the protruding portion. This arrangement not only increases the force with which the housing supports the bar-shaped members, but also causes no influence on the electric connection between a mating connector and the respective contact portions of the contacts.

DESCRIPTION OF EMBODIMENTS

The description below deals with a connector as an embodiment of this disclosure with reference to drawings. The embodiment described below is, as an example connector, an HDMI (registered trademark) Type A connector 100 for high-speed differential signal transmission. This disclosure is, however, not limited to the embodiment below, and may be altered variously without departing from its scope.

Figure 1:
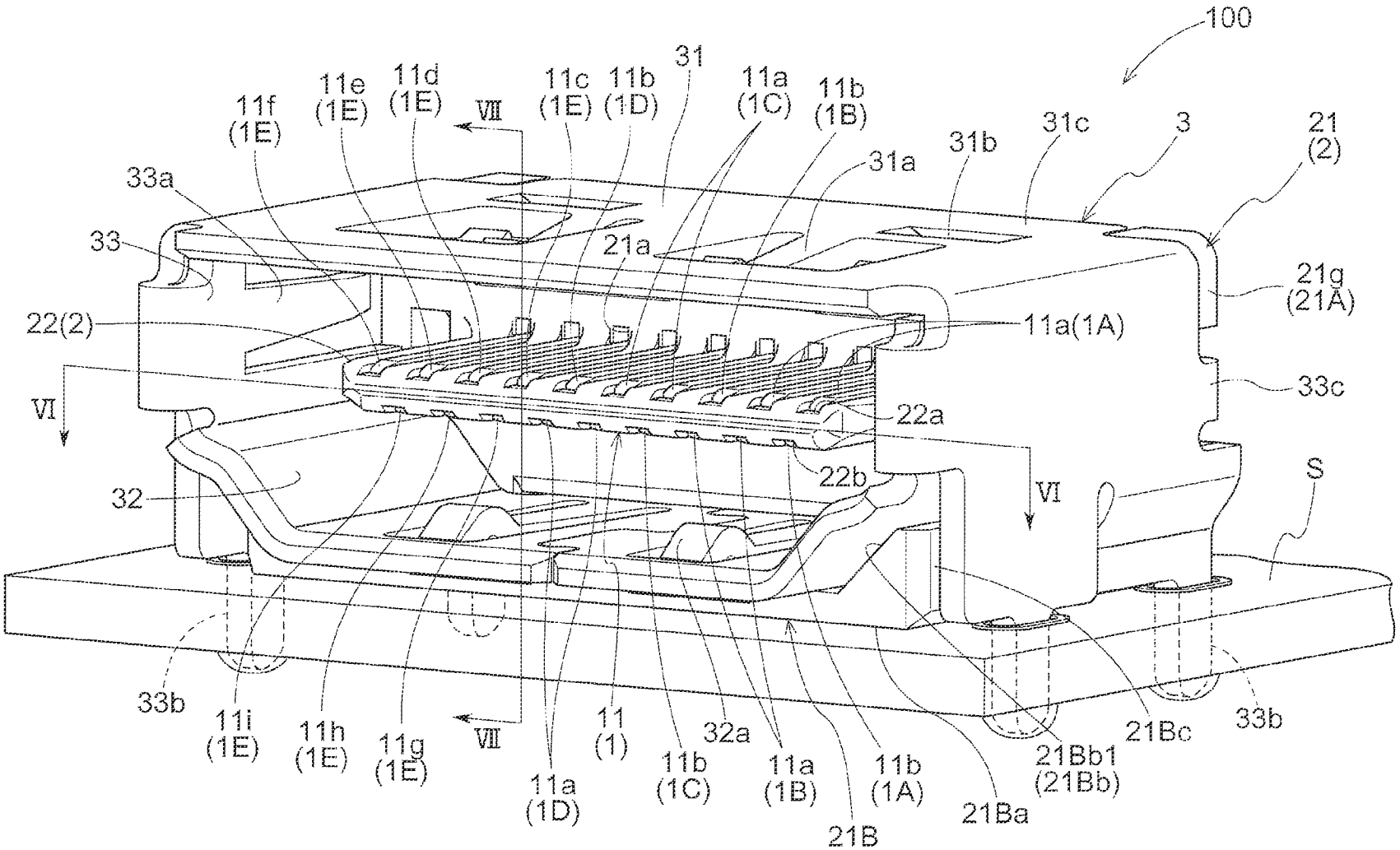
FIG. 1 is a perspective view of a connector, illustrating the entire connector from its front surface side.
Figure 2:
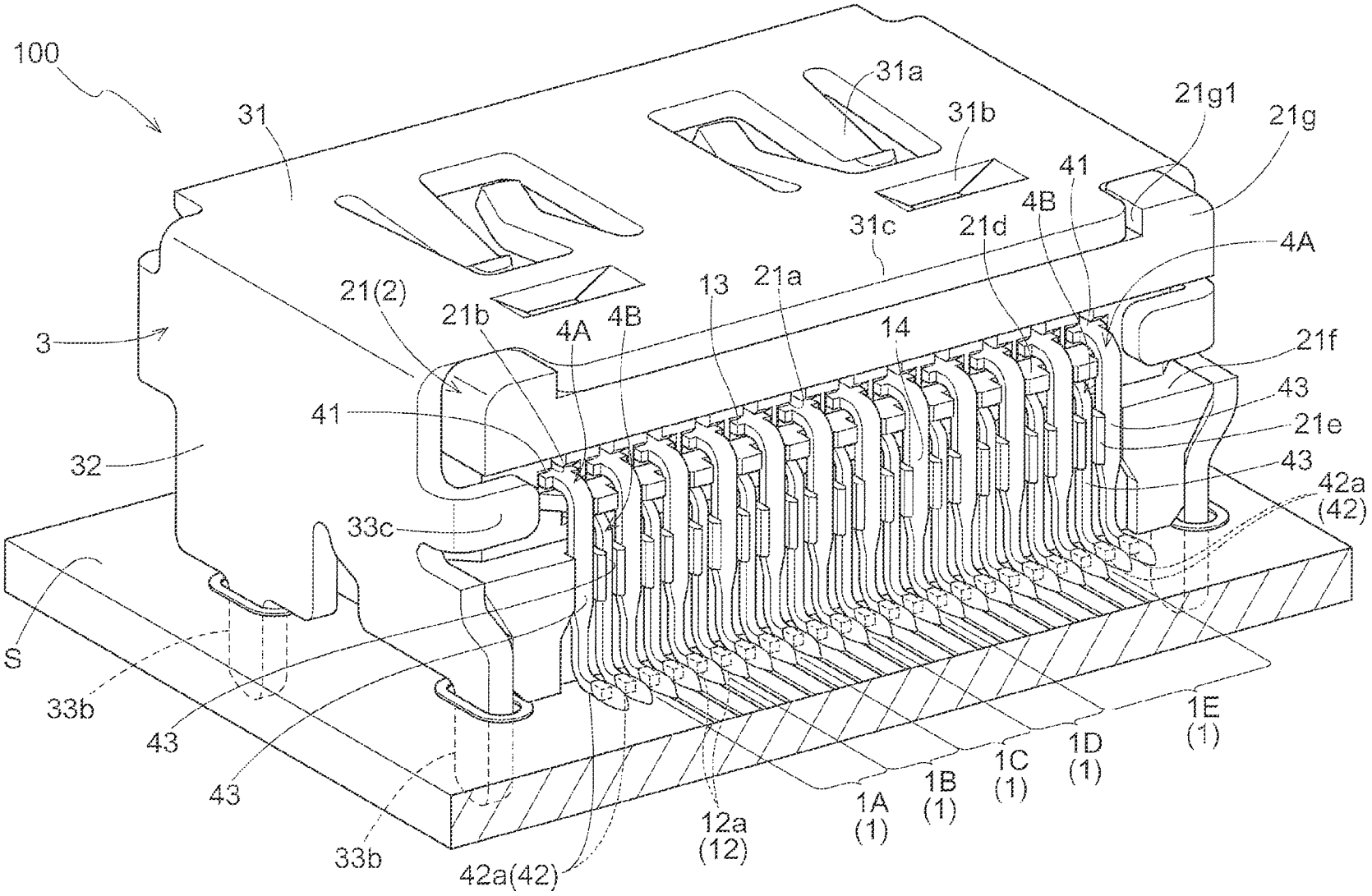
FIG. 2 is a perspective view of a connector, illustrating the entire connector from its back surface side.

As illustrated in FIGS. 1 and 2, the connector 100 includes a plurality of (19 for the present embodiment) contacts 1 electrically connectable to a mating connector (not illustrated in the drawings), a housing 2 supporting the plurality of contacts 1, and a shell 3 covering the plurality of contacts 1 and the housing 2 and protecting the contacts 1 from external electromagnetic waves. The contacts 1 and the shell 3 are each molded from an electrically conductive material such as metal. The housing 2 is molded from an electrically insulative material such as resin.

Figure 3:
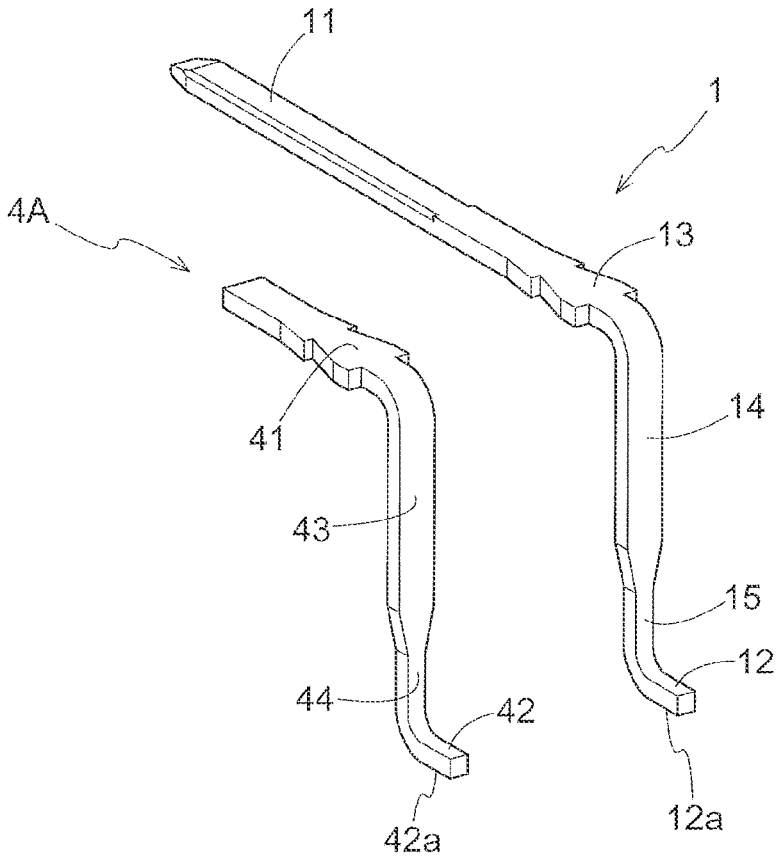
FIG. 3 is a perspective view of a contact and a bar-shaped member.

As illustrated in FIG. 3, each contact 1 has a linear contact portion 11 at a first end thereof and a fixing portion 12 at a second end thereof. The contact portion 11 is a portion to which a terminal of a mating connector is electrically connectable. The fixing portion 12 is a portion soldered or otherwise fixed to a substrate S. Each contact 1 also has a press-fit portion 13, a vertical portion 14, and a connection portion 15 all present between the contact portion 11 and the fixing portion 12 and integral with one another. The press-fit portion 13 extends from the contact portion 11 with an increasing width and is press-fitted in the housing 2. The vertical portion 14 extends linearly from the press-fit portion 13 and bends perpendicularly thereto with a width equivalent to that of the contact portion 11. The connection portion 15 extends from the vertical portion 14 with a tapered width and connects to the fixing portion 12 with a width equivalent to that of the fixing portion 12. The fixing portion 12 is perpendicular to the connection portion 15 and parallel to the substrate S. The fixing portion 12 has a flat fixing face 12*a* soldered or otherwise fixed to the substrate S for electric connection with a circuit on the substrate S.

As illustrated in FIG. 1, the nineteen contacts 1 are apart from one another and arranged next to one another in a first row and a second row parallel to each other. The first row, which is shown on the upper side of FIG. 1, includes even-numbered (ten) contacts 1 arranged next to one another at a predetermined distance. The second row, which is shown on the lower side of FIG. 1, includes odd-numbered (nine) contacts 1 arranged next to one another at the predetermined distance. The plurality of contacts 1 are, in other words, all evenly spaced from one another and have a staggered arrangement in two rows. The nineteen contacts 1 are constituted by four sets of three contacts 1 and one set of seven contacts 1. The four sets (shown in the drawings as contacts 1A, 1B, 1C, and 1D) are each made up of one ground terminal and two signal terminals as a differential pair. The one set (shown in the drawings as contacts 1E) includes a control CEC terminal.

The differential signal terminals for use in TMDSData2+ and TMDSData2− transmission correspond to, among the three contacts 1A, 1B, 1C, 1D of each of the four sets, a pair of contacts 1A and 1A, a pair of contacts 1B and 1B, a pair of contacts 1C and 1C, and a pair of contacts 1D and 1D each present in the same row and having respective contact portions 11*a* adjacent to each other. In other words, these pairs of contacts 1A and 1A, contacts 1B and 1B, contacts 1C and 1C, and contacts 1D and 1D each serve as a differential pair, whereas the remaining single contacts 1A, 1B, 1C, and 1D, each present in the other row and among the pairs of adjacent contact portions 11*a* and having a contact portion 11*b*, each serve as a ground terminal.

The seven contacts 1E are specifically as follows: That contact 1E which has the innermost contact portion 11*c* in the first row serves as a CEC terminal for use in transmission of a CEC signal as control data. That contact 1E which has a contact portion 11*d* adjacent to the contact portion 11*c* serves as a terminal for use in transmission of a serial clock (SCL) signal as a clock signal for use in synchronization for transmission of a SDA signal. That contact 1E which has a contact portion 11*e* adjacent to the contact portion 11*d* serves as a CEC/DDC ground terminal. That contact 1E which has the outermost contact portion 11*f* adjacent to the contact portion 11*e* serves as a hot plug detection terminal for detecting the state of connection to a mating connector. That contact 1E which has the innermost contact portion 11*g* in the second row is reserved. That contact 1E which has a contact portion 11*h* adjacent to the contact portion 11*g* serves as a terminal for use in transmission of a serial data (SDA) signal such as an E-EDID signal. That contact 1E which has the outermost contact portion 11*i* adjacent to the contact portion 11*h* serves as a power source terminal.

As described above, three contacts 1A, 1B, 1C, 1D form a set. Those contacts 1A, 1B, 1C, and 1D each of which has a contact portion 11*b* and serves as a ground terminal share an equal electric potential while being supplied with electricity. The pair of contacts 1A and 1A having respective contact portions 11*a* are surrounded by those contacts 1A and 1B which have respective contact portions 11*b*. The pair of contacts 1B and 1B having respective contact portions 11*a* are surrounded by those contacts 1A, 1B and 1C which have respective contact portions 11*b*. The pair of contacts 1C and 1C having respective contact portions 11*a* are surrounded by those contacts 1B, 1C and 1D which have respective contact portions 11*b*. The pair of contacts 1D and 1D having respective contact portions 11*a* are surrounded by those contacts 1C and 1D which have respective contact portions 11*b*. TMDSData2+ and TMDSData2− transmission signals, which are high-frequency signals, each have a stable impedance property as the pairs of contacts 1A and 1A, contacts 1B and 1B, contacts 1C and 1C, and contacts 1D and 1D are each surrounded by a plurality of ground terminals having respective contact portions 11*b*.

Similarly, that contact 1E which has a contact portion 11*c* for transmission of a CEC signal, that contact 1E which has a contact portion 11*d* for transmission of a SCL signal, and that contact 1E which has a contact portion 11*h* for transmission of an SDA signal are each surrounded by that contact 1D which has a contact portion 11*b* and which serves as a ground terminal and that contact 1E which has a contact portion 11*e* and which serves as a ground terminal.

The contacts 1 are arranged as described above. Thus, in the first row, no outwardly adjacent terminal is present next to the contact 1A which has an outermost contact portion 11*a* among the differential pairs or that contact 1E which has a contact portion 11*f* as a hot plug detection terminal, and in the second row, no outwardly adjacent terminal is present next to that contact 1A which has a contact portion 11*b* and which serves as a ground terminal or that contact 1E which has a contact portion 11*i* and which serves as a power source terminal. Of the outermost contacts 1A and 1E, the contacts 1A having respective contact portions 11*a* serve to transmit a high-frequency signal. Of the seven contacts 1E, only that contact 1E which has a contact portion 11*e* serves as a ground terminal. Those contacts 1A and 1E which have respective contact portions 11*a*, 11*c*, 11*d*, and 11*h* and which serve to transmit a high-frequency signal are each surrounded by a fewer number of ground terminals, and would thus each normally have a high impedance as compared to the contacts 1 having the other contact portions 11. This would result in an impedance imbalance between the contacts 1A and 1E and the other contacts. The impedance property would differ between the differential pair of the outermost contacts 1A and the respective other differential pairs of the contacts 1B, 1C and 1D, in particular.

As illustrated in FIG. 2, the connector 100 includes two first bar-shaped members 4A for the first row that are electrically conductive and that are supported by the housing 2. The first bar-shaped members 4A are present further outward than the outermost contacts 1A and 1E among the plurality of contacts 1. The first bar-shaped members 4A each have a second fixing portion 42 to which a terminal of a mating connector is not electrically connectable and which is soldered or otherwise fixed to the substrate S for grounding. The connector 100 further includes two second bar-shaped members 4B for the second row that are electrically conductive and that are supported by the housing 2. The second bar-shaped members 4B are present further outward than the outermost contacts 1A and 1E among the plurality of contacts 1. The second bar-shaped members 4B each have a second fixing portion 42 to which a terminal of a mating connector is not electrically connectable and which is fixed to the substrate S for grounding. The bar-shaped members 4A and 4B are each prepared by cutting the contact portion 11 off a contact 1 (see FIG. 3). This means that the bar-shaped members 4A and 4B each have a second fixing portion 42 corresponding to the fixing portion 12 of a contact 1, a second press-fit portion 41 corresponding to the press-fit portion 13 of a contact 1, a second vertical portion 43 corresponding to the vertical portion 14 of a contact 1, and a second connection portion 44 corresponding to the connection portion 15 of a contact 1. The second fixing portion 42 is perpendicular to the second connection portion 44 and parallel to the substrate S. The second fixing portion 42 has a flat second fixing face 42*a* soldered or otherwise fixed to the substrate S. Preparing first bar-shaped members 4A and second bar-shaped members 4B by cutting the respective contact portions 11 off contacts 1 as described above allows mass production of identically shaped contacts 1 and thereby reduces the production cost.

With reference to FIG. 2 again, the first bar-shaped members 4A are present next to the outermost contacts 1A and 1E in the first row, apart therefrom by a predetermined distance, and opposite to each other in such a manner as to enclose a plurality of (ten) contacts 1. Similarly, the second bar-shaped members 4B are present next to the outermost contacts 1A and 1E in the second row, apart therefrom by the predetermined distance, and opposite to each other in such a manner as to enclose a plurality of (nine) contacts 1. The plurality of contacts 1, the first bar-shaped members 4A, and the second bar-shaped members 4B are, as viewed from behind the connector 100, arranged next to one another and all evenly spaced from one another.

The connector 100, as mentioned above, includes first bar-shaped members 4A and second bar-shaped members 4B both supported by the housing 2, the bar-shaped members 4A and 4B being not electrically connectable to a mating connector and serving to protect the contacts. The connector 100, in other words, includes first bar-shaped members 4A and second bar-shaped members 4B present outward of signal transmission contacts 1 for contact protection. This prevents detachment of the contacts 1 from the substrate S without impairing the signal transmission function of the connector 100. Further, the bar-shaped members 4A and 4B are present respectively for the two rows, and thereby keep the contacts 1 fixed to the substrate S firmly. The contacts 1A and 1E having respective contact portions 11*a*, 11*c*, 11*d*, and 11*h* are each surrounded by a fewer number of ground terminals and would thus each tend to have a high impedance. In view of that, the electrically conductive first bar-shaped members 4A and second bar-shaped members 4B are present further outward than those contacts 1A and 1E and each serve as a ground terminal. This reduces the respective impedances of the contacts 1A and 1E, and thereby adjusts the impedance balance throughout the connector 100.

The connector 100 includes two first bar-shaped members 4A for a first row that are opposite to each other in such a manner as to enclose a plurality of contacts 1 and two second bar-shaped members 4B for a second row that are opposite to each other in such a manner as to enclose a plurality of contacts 1. This keeps the contacts 1 fixed to the substrate S more firmly, and thereby reliably prevents the contacts 1 from becoming detached. The connector 100 includes (i) even-numbered contacts 1 next to one another at an equal distance in a first row, (ii) odd-numbered contacts 1 next to one another at the equal distance in a second row, (iii) two first bar-shaped members 4A each next to an outermost contact 1 in the first row at the same distance, and (iv) two second bar-shaped members 4B each next to an outermost contact 1 in the second row at the same distance. This allows the contacts 1 and the bar-shaped members 4A and 4B both fixed to the substrate S to be next to one another in a well-balanced pattern. This allows the contacts 1 to be fixed to the substrate S more firmly, and thereby reliably prevents the contacts 1 from becoming detached.

Figure 4:
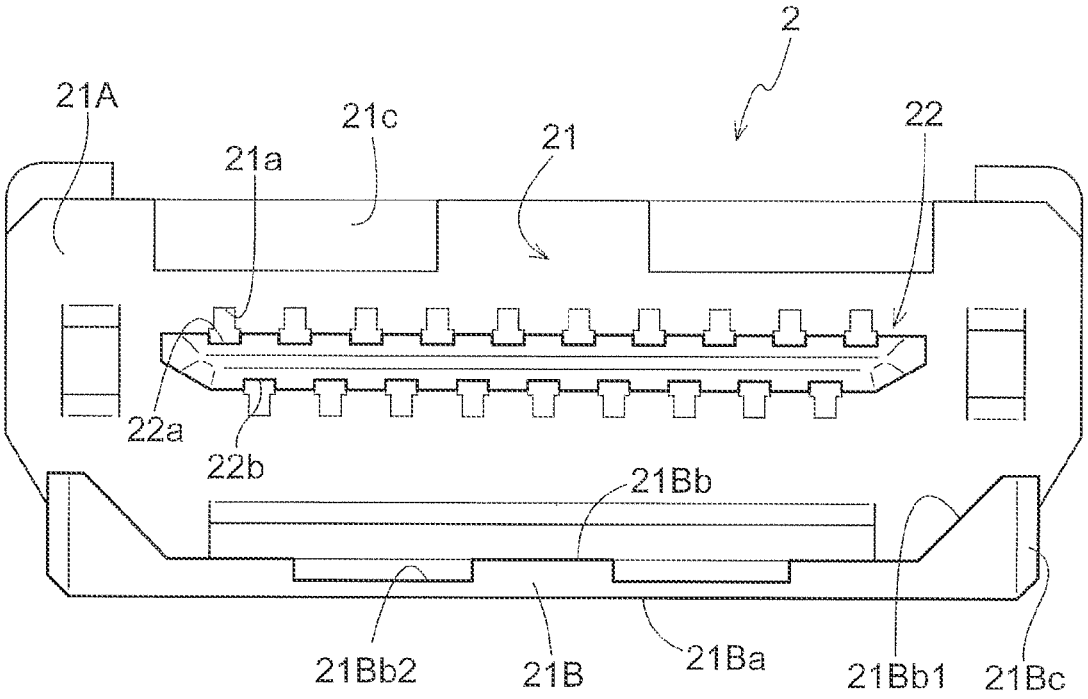
FIG. 4 is a front view of a housing.
Figure 5:
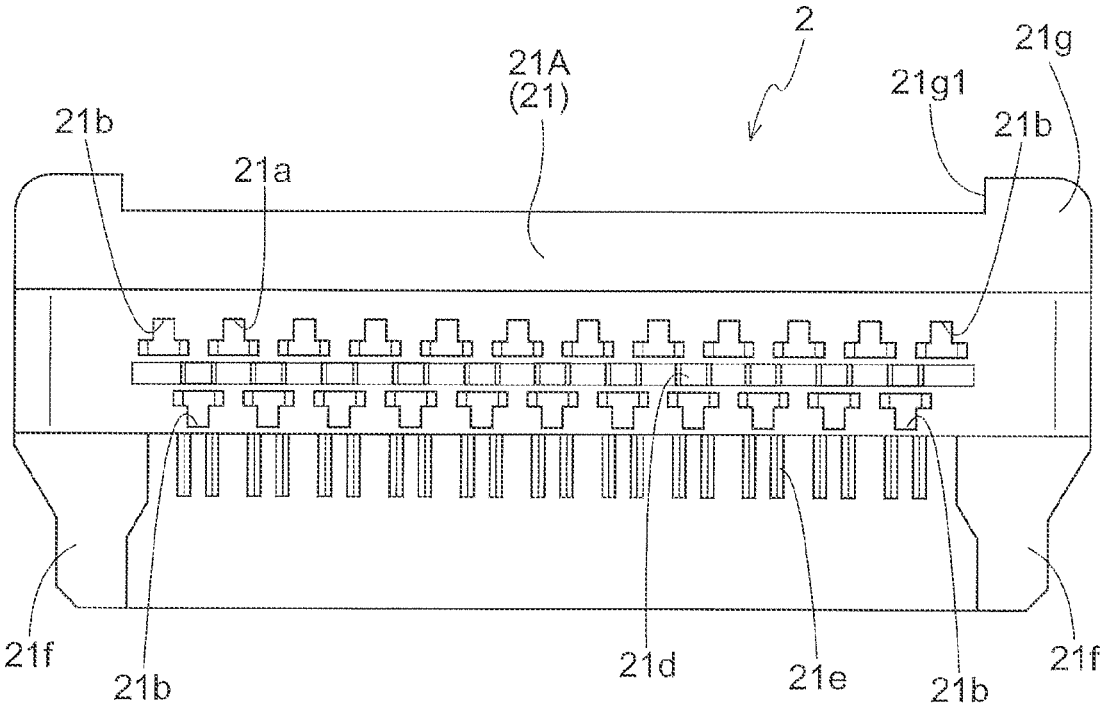
FIG. 5 is a rear view of a housing.
Figure 7:
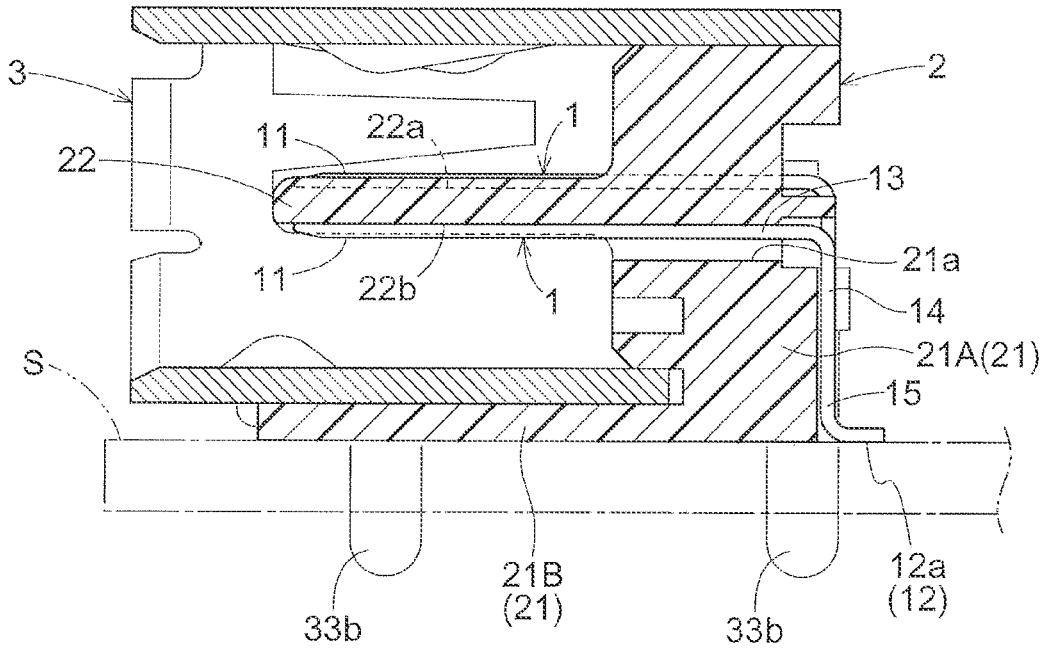
FIG. 7 is a cross-sectional view of the connector in FIG. 1 taken along line VII-VII.

As illustrated in FIG. 7, the housing 2 includes a base portion 21 and a protruding portion 22 protruding from the base portion 21 and supporting the contacts 1. As illustrated in FIGS. 4 and 5, the base portion 21 has a plurality of (nineteen) through holes 21*a* and a plurality of (four) hole portions 21*b*. The through holes 21*a* each have a T-shaped cross section and receive a contact 1 inserted therein. The hole portions 21*b* each have a T-shaped cross section, are blocked on the side of the protruding portion 22, and each receive a first bar-shaped member 4A or second bar-shaped member 4B inserted therein. FIG. 4 is a front view of the housing 2, with the plurality of hole portions 21*b* invisible. FIG. 5 is a rear view of the housing 2, with the plurality of hole portions 21*b* visible.

As illustrated in FIG. 7, the base portion 21 includes a block-shaped base body 21A and a bottom portion 21B protruding from the base body 21A parallel to the protruding portion 22 and supporting the shell 3. The protruding portion 22 protrudes from a central portion of the base body 21A in the shape of a plate, and is integral with the base body 21A.

As illustrated in FIG. 4, the base body 21A has, on a front surface thereof, restriction depressions 21*c* in which contact protrusions 31*b* of the shell 3 are fitted. As illustrated in FIGS. 2 and 5, the base body 21A has a plurality of (11 for the present embodiment) first alignment protrusions 21*d* and a plurality of (22 for the present embodiment) second alignment protrusions 21*e* on a back surface thereof. The plurality of first alignment protrusions 21*d* are lateral to the through holes 21*a* and hole portions 21*b* in the first row, and support the respective vertical portions 14 of the contacts 1 in the first row and the respective second vertical portions 43 of the first bar-shaped members 4A. The plurality of second alignment protrusions 21*e* are lateral to the through holes 21*a* and hole portions 21*b* in the second row, and support the respective vertical portions 14 of the contacts 1 in the second row and the respective second vertical portions 43 of the second bar-shaped members 4B. Each pair of second alignment protrusions 21*e* that sandwich the vertical portion 14 of a contact 1 in the second row and the second vertical portion 43 of a second bar-shaped member 4B also serve to (i) separate the contacts 1 and the first bar-shaped members 4A in the first row from the contacts 1 and the second bar-shaped members 4B in the second row and (ii) support the contacts 1 in the first row and the first bar-shaped members 4A.

The base body 21A includes, at opposite sides of its back surface, a pair of third alignment protrusions 21*f* each protruding by the same amount as the second alignment protrusions 21*e*. Each third alignment protrusion 21*f* and its adjacent second alignment protrusion 21*e* support the second vertical portion 43 of a first bar-shaped member 4A. The base body 21A further includes, on its back surface, a block-shaped portion 21*g* present across the first alignment protrusions 21*d* from the third alignment protrusions 21*f* and extending in the direction in which the contacts 1 are arranged. The block-shaped portion 21*g* has, on a top surface thereof, a long groove 21*g*1 for guiding the shell 3 for insertion thereof. The block-shaped portion 21*g* is also in contact with those opposite portions of the shell 3 which are lateral to an engagement protrusion 31*c* (described later) of the shell 3 to restrict movement of the shell 3 toward the back surface side.

As illustrated in FIGS. 1 and 4, the bottom portion 21B of the base portion 21 has a bottom outer face 21Ba, a bottom inner face 21Bb, and a pair of bottom side faces 21Bc. The bottom inner face 21Bb has a pair of tapered faces 21Bb1 at its opposite side portions, so the bottom portion 21B is in the shape of a mortar. The bottom portion 21B has a plurality of (two for the present embodiment) groove portions 21Bb2 between the pair of tapered faces 21Bb1 of the bottom inner face 21Bb. The groove portions 21Bb2 are each a space in which a second elastic piece 32*a* (described later) of the shell 3 is elastically deformable.

Figure 6:
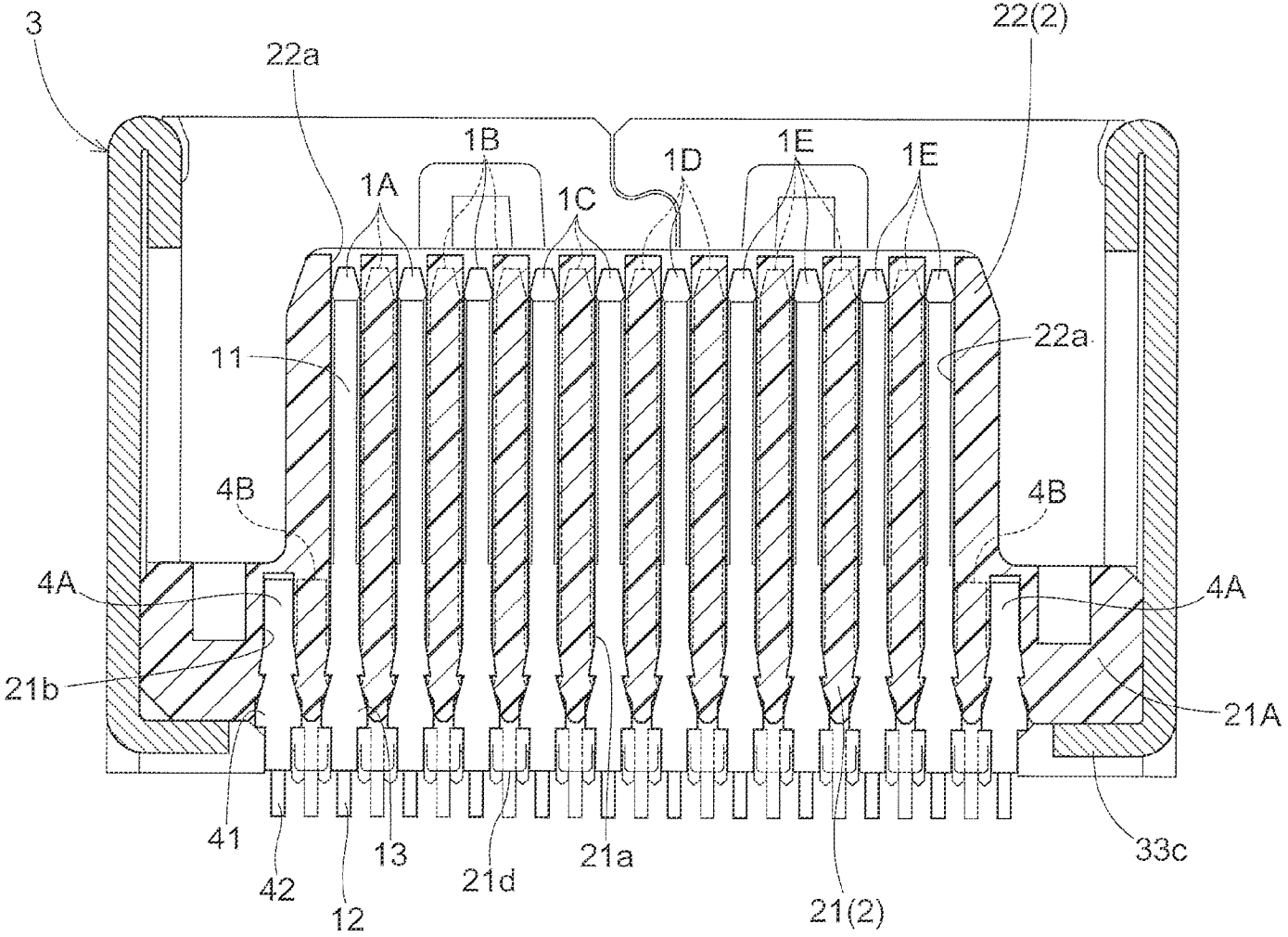
FIG. 6 is a cross-sectional view of the connector in FIG. 1 taken along line VI-VI.

As illustrated in FIGS. 1, 4, and 6, the protruding portion 22 includes a plurality of (ten for the present embodiment) first alignment depressions 22*a* on a first surface thereof. The first alignment depressions 22*a* extend in the direction in which the respective contact portions 11 of the contacts 1 in the first row extend, and support those contact portions 11. The first alignment depressions 22*a* communicate with the through holes 21*a* in the first row. Similarly, the protruding portion 22 includes a plurality of (nine for the present embodiment) second alignment depressions 22*b* on a second surface thereof. The second alignment depressions 22*b* extend in the direction in which the respective contact portions 11 of the contacts 1 in the second row extend, and support those contact portions 11. The second alignment depressions 22*b* communicate with the through holes 21*a* in the second row. The first alignment depressions 22*a* and the second alignment depressions 22*b* are, in other words, all evenly spaced from one another and have a staggered arrangement in two rows, similarly to the plurality of contacts 1.

Figure 8:
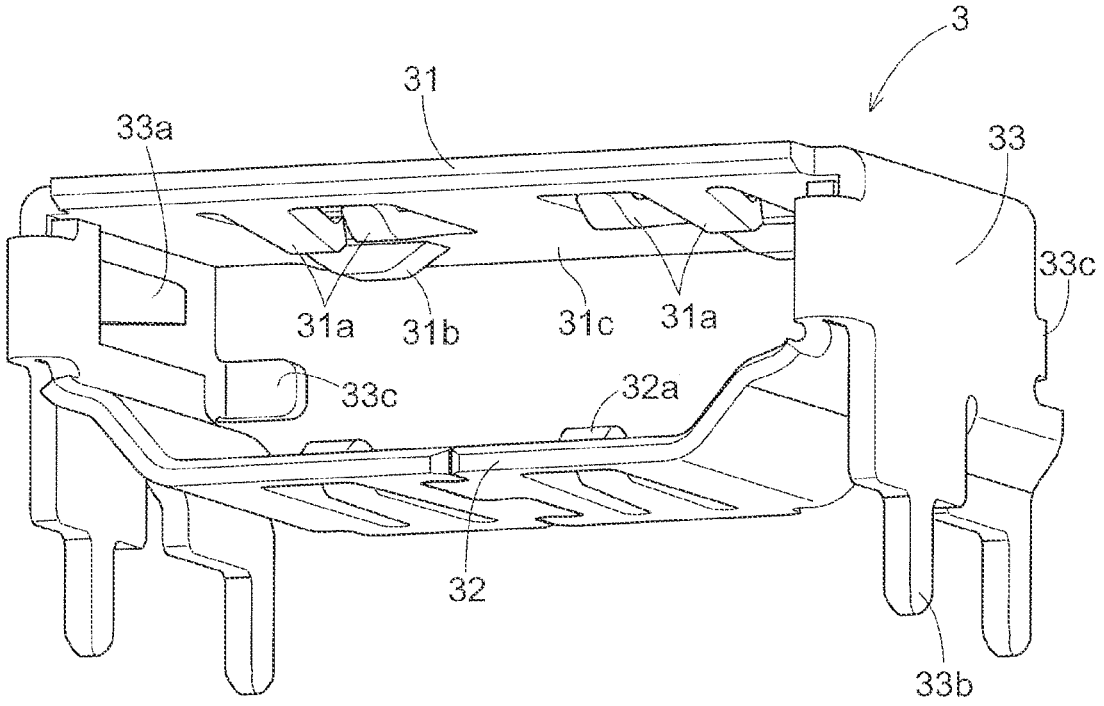
FIG. 8 is a perspective view of a shell.

As illustrated in FIG. 8, the shell 3 is a thin metal plate that has been punched out and bent and that has a hexagonal opening in which a mating connector is insertable. The shell 3 includes a top wall 31, a bottom wall 32 opposite to the top wall 31, and a pair of side walls 33 connecting the top wall 31 with the bottom wall 32.

The top wall 31 includes a plurality of (four for the present embodiment) first elastic pieces 31*a* resulting from punching out the top wall 31 and a plurality of (two for the present embodiment) contact protrusions 31*b* resulting from drawing the top wall 31 inward. The plurality of contact protrusions 31*b* function as a stopper when a mating connector has been inserted. The top wall 31 further includes, on a back surface side of the shell 3, an engagement protrusion

31*c* engaged with the long groove 21*g*1 of the housing 2 (see also FIG. 2). The bottom wall 32 is shaped to fit with the mortar-shaped bottom portion 21B, and includes a plurality of (two for the present embodiment) second elastic pieces 32*a* resulting from punching out the bottom wall 32.

The side walls 33 are each bent inward at 180 degrees on the front surface side of the shell 3. The side walls 33 include (i) a plurality of (two for the present embodiment) third elastic pieces 33*a*, (ii) a plurality of (four for the present embodiment) leg portions 33*b* each inserted in a through hole in the substrate S and soldered or otherwise fixed to the substrate S, and (iii) a plurality of (two for the present embodiment) bend pieces 33*c* each resulting from bending the corresponding side wall 33 inward at 90 degrees on the back surface side of the shell 3. The first elastic pieces 31*a* of the top wall 31, the second elastic pieces 32*a* of the bottom wall 32, and the third elastic pieces 33*a* of the side walls 33 are engageable with a mating connector while being elastically deformed. This allows the mating connector to be fixed to the connector 100. The bend pieces 33*c* are bent after the shell 3 is attached to the housing 2. This causes the bend pieces 33*c* to come into contact with the back surface of the housing 2, and thereby restricts movement of the shell 3 toward the front surface side (see FIG. 2).

The description below deals with how to assemble the connector 100. First, attach the shell 3 to the housing 2 from the front surface side with the bend pieces 33*c* parallel to the side walls 33 so that the engagement protrusion 31*c* of the top wall 31 is engaged with the long groove 21*g*1 in the housing 2 and that those opposite portions of the shell 3 which are lateral to the engagement protrusion 31*c* are in contact with the block-shaped portion 21*g* (see FIGS. 2, 4, and 8). Next, bend the bend pieces 33*c* inward at 90 degrees to restrict movement of the shell 3 toward the front surface side. Then, insert the respective contact portions 11 of the plurality of contacts 1 for the second row into the corresponding through holes 21*a* along the second alignment depressions 22*b* and the respective front-side tips of the second bar-shaped members 4B into the corresponding hole portions 21*b*, and press-fit the respective press-fit portions 13 of the above contacts 1 into the corresponding through holes 21*a* and the respective second press-fit portions 41 of the second bar-shaped members 4B into the corresponding hole portions 21*b* (see FIG. 6). Next, insert the respective contact portions 11 of the plurality of contacts 1 for the first row into the corresponding through holes 21*a* along the first alignment depressions 22*a* and the respective front-side tips of the first bar-shaped members 4A into the corresponding hole portions 21*b*, and press-fit the respective press-fit portions 13 of the above contacts 1 into the corresponding through holes 21*a* and the respective second press-fit portions 41 of the first bar-shaped members 4A into the corresponding hole portions 21*b* (see FIG. 6). This results in the following state: The respective vertical portions 14 of the plurality of contacts 1 in the first row and the respective second vertical portions 43 of the first bar-shaped members 4A are each supported by a pair of first alignment protrusions 21*d*, whereas the respective vertical portions 14 of the plurality of contacts 1 in the second row and the respective second vertical portions 43 of the second bar-shaped members 4B are each supported by a pair of second alignment protrusions 21*e* (see FIG. 2). The respective second vertical portions 43 of the first bar-shaped members 4A are each (i) present between a first alignment depression 22*a* and a bend piece 33*c* and (ii) sandwiched between and supported by a second alignment protrusion 21*e* and a third alignment protrusion 21*f* (see FIG. 2). The respective second vertical portions 43 of the second bar-shaped members 4B are each sandwiched between and supported by a pair of second alignment protrusions 21*e*. Next, solder or otherwise fix the respective fixing portions 12 of the contacts 1, the respective second fixing portions 42 of the first bar-shaped members 4A and the second bar-shaped members 4B, and the leg portions 33*b* of the shell 3 to the substrate S. This results in a connector 100 mounted on the substrate S as a finished product. The shell 3, the contacts 1, and the bar-shaped members 4A and 4B may be assembled to the housing 2 in any order. The contacts 1 and the bar-shaped members 4A and 4B may be press-fitted separately.

The present embodiment is arranged such that the hole portions 21*b*, which receive the first bar-shaped members 4A and the second bar-shaped members 4B, are blocked on the side of the protruding portion 22. This arrangement not only increases the force with which the housing 2 supports the bar-shaped members 4A and 4B, but also causes no influence on the electric connection between a mating connector and the respective contact portions 11 of the contacts 1.

[Alternative Embodiments]

(1) The embodiment described above includes two first bar-shaped members 4A opposite to each other in such a manner as to enclose a plurality of contacts 1 and two second bar-shaped members 4B opposite to each other in such a manner as to enclose a plurality of contacts 1. The embodiment may, however, be altered to include only one first bar-shaped member 4A on an outer side of a plurality of contacts 1 and/or only one second bar-shaped member 4B on an outer side of a plurality of contacts 1. In this case, the first bar-shaped member 4A and the second bar-shaped member 4B are preferably each present further outward than those contacts 1A which are outermost contacts 1 serving as a differential pair. This adjusts the impedance balance between the contacts 1A and the other pairs of contacts 1B, 1C and 1D, each serving as a differential pair.

(2) The first bar-shaped members 4A and the second bar-shaped members 4B may each be next to its adjacent contact 1 as separated therefrom by a distance different from the distance by which the plurality of contacts 1 are apart from one another. The connector 100 may alternatively include a plurality of first bar-shaped members 4A on only one outer side of a plurality of contacts 1 and/or a plurality of second bar-shaped members 4B on only one outer side of a plurality of contacts 1. The respective numbers and arrangements of the first bar-shaped members 4A and the second bar-shaped members 4B are each not limited to any particular number or arrangement.

(3) The hole portions 21*b* in the housing 2 may be unblocked on the side of the protruding portion 22 and be each in the shape of a through hole. In this case, the respective second press-fit portions 41 of the bar-shaped members 4A and 4B may each protrude on the front surface side and be bent at 90 degrees into contact with that wall surface of the base body 21A which is on the front surface side. This increases the force with which the housing 2 is held by the bar-shaped members 4A and 4B.

(4) The embodiment described above is a connector 100 as an HDMI (registered trademark) Type A receptacle connector. The connector 100 may, however, be an HDMI (registered trademark) connector of a type other than Type A or a connector based on a standard other than HDMI (registered trademark). Further, the connector 100 may alternatively be not a receptacle connector but a plug connector.

The invention claimed is:

1. A connector mounted on a substrate, the connector comprising:

a plurality of contacts each including at a first end a contact portion to which a terminal of a mating connector is electrically connectable and at a second end a fixing portion fixed to the substrate; and a housing supporting the plurality of contacts, wherein the plurality of contacts include a plurality of first contacts arranged next to one another in a first row and a plurality of second contacts arranged next to one another in a second row parallel to and apart from the first row, the connector further comprises:

for the first row, at least one electrically conductive first bar-shaped member which is present further outward than a first outermost one of the first contacts, which is fixed to the substrate, which is supported by the housing, and to which the mating connector is not electrically connectable; and for the second row, at least one electrically conductive second bar-shaped member which is present further outward than a first outermost one of the second contacts, which is fixed to the substrate, which is supported by the housing, and to which the mating connector is not electrically connectable.

2. The connector according to claim 1, wherein the at least one first bar-shaped member includes two first bar-shaped members opposite to each other in such a manner as to enclose the first contacts, and the at least one second bar-shaped member includes two second bar-shaped members opposite to each other in such a manner as to enclose the second contacts.

3. The connector according to claim 1, wherein the first contacts are present in an even number and next to one another at a predetermined distance, the second contacts are present in an odd number and next to one another at the predetermined distance, the at least one first bar-shaped member is next to the first outermost one of the first contacts at the predetermined distance, and the at least one second bar-shaped member is next to the first outermost one of the second contacts at the predetermined distance.

4. The connector according to claim 2, wherein the first contacts are present in an even number and next to one another at a predetermined distance, the second contacts are present in an odd number and next to one another at the predetermined distance, a first one of the two first bar-shaped members is next to the first outermost one of the first contacts at the predetermined distance, a second one of the two first bar-shaped members is next to a second outermost one of the first contacts at the predetermined distance, a first one of the two second bar-shaped members is next to the first outermost one of the second contacts at the predetermined distance, and a second one of the two second bar-shaped members is next to a second outermost one of the second contacts at the predetermined distance.

5. The connector according to claim 1, wherein the at least one first bar-shaped member and the at least one second bar-shaped member are each identical in shape to each of the plurality of contacts except for lack of the contact portion.

6. The connector according to claim 2, wherein the two first bar-shaped members and the two second bar-shaped members are each identical in shape to each of the plurality of contacts except for lack of the contact portion.

7. The connector according to claim 3, wherein the at least one first bar-shaped member and the at least one second bar-shaped member are each identical in shape to each of the plurality of contacts except for lack of the contact portion.

8. The connector according to claim 4, wherein the two first bar-shaped members and the two second bar-shaped members are each identical in shape to each of the plurality of contacts except for lack of the contact portion.

9. The connector according to claim 1, wherein the housing includes a base portion and a protruding portion protruding from the base portion and supporting the plurality of contacts, and the base portion has (i) a plurality of through holes in which the plurality of contacts are partially present and (ii) a plurality of hole portions which are blocked on a side of the protruding portion and in which the at least one first bar-shaped member and the at least one second bar-shaped member are partially present.

10. The connector according to claim 2, wherein the housing includes a base portion and a protruding portion protruding from the base portion and supporting the plurality of contacts, and the base portion has (i) a plurality of through holes in which the plurality of contacts are partially present and (ii) a plurality of hole portions which are blocked on a side of the protruding portion and in which the two first bar-shaped members and the two second bar-shaped members are partially present.

11. The connector according to claim 3, wherein the housing includes a base portion and a protruding portion protruding from the base portion and supporting the plurality of contacts, and the base portion has (i) a plurality of through holes in which the plurality of contacts are partially present and (ii) a plurality of hole portions which are blocked on a side of the protruding portion and in which the at least one first bar-shaped member and the at least one second bar-shaped member are partially present.

12. The connector according to claim 4, wherein the housing includes a base portion and a protruding portion protruding from the base portion and supporting the plurality of contacts, and the base portion has (i) a plurality of through holes in which the plurality of contacts are partially present and (ii) a plurality of hole portions which are blocked on a side of the protruding portion and in which the two first bar-shaped members and the two second bar-shaped members are partially present.

13. The connector according to claim 5, wherein the housing includes a base portion and a protruding portion protruding from the base portion and supporting the plurality of contacts, and the base portion has (i) a plurality of through holes in which the plurality of contacts are partially present and (ii) a plurality of hole portions which are blocked on a side of the protruding portion and in which the at least one first bar-shaped member and the at least one second bar-shaped member are partially present.

14. The connector according to claim 6, wherein the housing includes a base portion and a protruding portion protruding from the base portion and supporting the plurality of contacts, and the base portion has (i) a plurality of through holes in which the plurality of contacts are partially present and (ii) a plurality of hole portions which are blocked on a side of the protruding portion and in which the two first bar-shaped members and the two second bar-shaped members are partially present.

15. The connector according to claim 7, wherein the housing includes a base portion and a protruding portion protruding from the base portion and supporting the plurality of contacts, and the base portion has (i) a plurality of through holes in which the plurality of contacts are partially present and (ii) a plurality of hole portions which are blocked on a side of the protruding portion and in which the at least one first bar-shaped member and the at least one second bar-shaped member are partially present.

16. The connector according to claim 8, wherein the housing includes a base portion and a protruding portion protruding from the base portion and supporting the plurality of contacts, and the base portion has (i) a plurality of through holes in which the plurality of contacts are partially present and (ii) a plurality of hole portions which are blocked on a side of the protruding portion and in which the two first bar-shaped members and the two second bar-shaped members are partially present.

* * * * *